US010301069B2

(12) United States Patent
Nakai

(10) Patent No.: US 10,301,069 B2
(45) Date of Patent: May 28, 2019

(54) CONTAINER

(71) Applicant: SANKO CO., LTD., Mizuho-shi, Gifu (JP)

(72) Inventor: Hidetsugu Nakai, Motosu (JP)

(73) Assignee: SANKO CO., LTD., Mizohu-shi (JP)

( * ) Notice: Subject to any disclaimer, the term of this patent is extended or adjusted under 35 U.S.C. 154(b) by 100 days.

(21) Appl. No.: 15/310,972

(22) PCT Filed: Dec. 12, 2014

(86) PCT No.: PCT/JP2014/082928
§ 371 (c)(1),
(2) Date: Nov. 14, 2016

(87) PCT Pub. No.: WO2015/198504
PCT Pub. Date: Dec. 30, 2015

(65) Prior Publication Data

US 2017/0073107 A1 Mar. 16, 2017

(30) Foreign Application Priority Data

Jun. 23, 2014 (JP) ..... 2014-128026

(51) Int. Cl.
*B65D 6/00* (2006.01)
*B65D 21/02* (2006.01)
(Continued)

(52) U.S. Cl.
CPC ..... *B65D 21/0215* (2013.01); *B65D 11/1833* (2013.01); *B65D 21/0212* (2013.01); *B65D 88/522* (2013.01)

(58) Field of Classification Search
CPC ..... B65D 21/0215; B65D 21/0212; B65D 21/0235; B65D 21/02; B65D 21/086;
(Continued)

(56) References Cited

U.S. PATENT DOCUMENTS 7,861,879 B2 * 1/2011 Samprathi ..... B65D 11/1833 220/6
2003/0116564 A1 * 6/2003 Overholt ..... B65D 11/1833 220/7
(Continued)

FOREIGN PATENT DOCUMENTS

EP 1477414 * 11/2004 ..... B65D 11/1833
JP H11-314637 A 11/1999
(Continued)

OTHER PUBLICATIONS

Dec. 27, 2016 International Preliminary Report on Patentability issued in International Patent Application No. PCT/JP2014/082928.
(Continued)

*Primary Examiner* — Fenn C Mathew
*Assistant Examiner* — Elizabeth J Volz
(74) *Attorney, Agent, or Firm* — Oliff PLC

(57) ABSTRACT

[Problem] To provide containers stronger than conventional containers with respect to a lateral load when stacked. [Solution] The containers according to the present invention are configured so that a corner engaging projection and a corner engaging recess are engaged at the four corners on the bottom face and the top face of a top and a bottom container when stacked, thereby allowing such containers to hold up against the lateral load received when stacked by dispersing the lateral load more widely than conventional containers. Thus, the present invention achieves a higher strength with respect to the lateral load when stacked than conventional containers and prevents incidents where a first sidewall and second sidewall would be separated from each other due to the first sidewall or second sidewall being pushed and bent outwards.

4 Claims, 13 Drawing Sheets

(51) Int. Cl.
*B65D 88/52* (2006.01)
*B65D 6/18* (2006.01)

(58) Field of Classification Search
CPC ..... B65D 11/1833; B65D 88/522; B65D 2519/009; B65D 2519/00865; B65D 2519/00875; B65D 1/225
USPC ..... 220/6, 7, 4.28
See application file for complete search history.

(56) References Cited

U.S. PATENT DOCUMENTS

| | | | | |
|---|---|---|---|---|
| 2004/0226946 | A1 | 11/2004 | Yamauchi | |
| 2010/0230406 | A1* | 9/2010 | Yamauchi | B65D 11/1833 220/7 |
| 2011/0049144 | A1* | 3/2011 | Koefelda | B65D 11/1833 220/6 |

FOREIGN PATENT DOCUMENTS

| | | | | |
|---|---|---|---|---|
| JP | 2006-335388 | A | 12/2006 | |
| JP | 2006335388 | * | 12/2006 | B65D 21/02 |
| JP | 3883984 | B2 | 2/2007 | |
| JP | 3958186 | B2 | 8/2007 | |

OTHER PUBLICATIONS

Mar. 17, 2015 International Search Report issued in International Patent Application No. PCT/JP2014/082928.
Jul. 3, 2018 Office Action issued in Japanese Patent Application No. 2014-128026.
Apr. 30, 2018 Office Action issued in Philippines Patent Application No. 1/2016/502341.

* cited by examiner

CONTAINER

TECHNICAL FIELD

The present invention relates to a container which shows a box shape open at a top face, and allows folding down one pair of first sidewalls facing each other by turning around lower end portions and then folding down the other pair of second sidewalls by turning around lower end portions.

BACKGROUND ART

Conventionally, as a container of this type, known is one having a structure in which, when the containers are stacked, a bottom-face projection provided for the upper-layer container is fitted inside a top-face opening of the lower-layer container to prevent lateral shift. Also, on both side portions of a second sidewall of the container, side projection pieces that are overlapped with a side portion of a first sidewall from the outside are provided, and by engagement of a side engaging hole formed in the side projection piece and a side engaging projection projecting from an outer face of the side portion of the first sidewall, the first sidewall and the second sidewall adjacent to each other are joined (refer to, for example, Patent Literature 1).

RELATED ART DOCUMENTS

Patent Documents

Patent Document 1: Japanese Patent No. 3883984 (FIG. 1 and FIG. 9)

DISCLOSURE OF THE INVENTION

Problems to be Solved by the Invention

Meanwhile, containers in which content is stored are sometimes stacked and loaded on a vehicle and transported. Also, a great lateral load may be exerted to one sidewall of the lower-layer container when the vehicle is accelerated or decelerated. In such a case, with the conventional containers described above, an incident could have occurred in which the sidewalls would be separated from each other due to the sidewall having received the lateral load being pushed and bent outwards. Particularly, when the second sidewall received a large load, an incident could have occurred in which the side engaging projection would be sheared.

The present invention has been made in view of the circumstances described above, and an object thereof is to provide a container which has a higher strength with respect to a lateral load when the containers are stacked than conventional containers.

Means of Solving the Problems

A container according to an invention of claim 1 made to achieve the object described above is a container which shows a box shape open at a top face, and allows folding down one pair of first sidewalls facing each other by turning around lower end portions and then folding down the other pair of second sidewalls by turning around lower end portions, and is characterized by including a bottom-face main projection that projects from a region of a bottom face of the container at an inner side than directly under the first sidewall and the second sidewall, and is fitted inside an opening in a top face of the container which is a lower layer when the containers are stacked, a bottom-face sub-projection that projects, at four corners of the bottom face of the container, from a region directly under the first sidewall and the second sidewall, and has a lower face flush with a lower face of the bottom-face main projection, a projection receiving recess that is formed across the first sidewall and the second sidewall adjacent to each other in corner portions at four corners of the top face of the container, and receives the bottom-face sub-projection of the container which is an upper layer when the containers are stacked, a corner engaging recess formed in the lower face of the bottom-face sub-projection, and a corner engaging projection that projects from a bottom face of the projection receiving recess, and is engaged with the corner engaging recess of the container which is an upper layer when the containers are stacked to restrain a lateral shift of the upper and lower containers with respect to each other.

An invention of claim 2 is the container according to claim 1, characterized by including a side projection piece that extends from each side portion of the second sidewall, and is overlapped with an outer side of each side portion of the first sidewall, a side engaging hole formed in the side projection piece, a side engaging projection that projects from an outer face of each side portion of the first sidewall, and is engaged with the side engaging hole, and the corner engaging projection provided for only the first sidewall.

An invention of claim 3 is the container according to claim 2, characterized by including the corner engaging projection disposed at a position to overlap the side projection piece when viewed in a facing direction of the first sidewalls to each other.

An invention of claim 4 is the container according to claim 3, characterized in that at least a part of the corner engaging projection and at least a part of the side engaging projection are disposed at the same position in a facing direction of the second sidewalls to each other.

Effects of the Invention

With the container of claim 1, the corner engaging projection and the corner engaging recess are engaged at the four corners on the bottom face and the top face of a top container and a bottom container when stacked, which thereby allows such containers to hold up against the lateral load received when stacked by dispersing the lateral load more widely than conventional containers. Thus, the containers achieve a higher strength with respect to the lateral load when stacked than conventional containers and prevent incidents where the adjacent sidewalls would be separated from each other due to one sidewall being pushed and bent outwards. Also, because the corner engaging projection projects from the bottom face of the projection receiving recess, the corner engaging projection does not also obstruct motion of taking content in and out of the container.

With the container of claim 2, when the second sidewall of the lower-layer container is pressed by a lateral load received by the stacked containers, the lateral load is received by not only the side engaging projection provided for the first sidewall of the lower-layer container but also the corner engaging projection. Accordingly, the side engaging projection is reduced in load share to prevent an incident where the side engaging projection would be sheared as conventionally occurred.

When the first sidewall of the lower-layer container is pressed by a lateral load received by the stacked containers, according to the configuration of claim 3, because the side projection piece and the corner engaging projection are disposed at a position to overlap each other when viewed in the facing direction of the first sidewalls to each other, incidents are prevented in which a section between the side projection piece and the corner engaging projection of the container would be deformed to bend by a lateral load received by the side projection piece and a lateral load received by the corner engaging projection, and a higher strength is achieved.

Also, when the first sidewall of the lower-layer container is pressed by a lateral load received by the stacked containers, the first sidewall is deformed to bulge out so that the first sidewall bulges in its lateral center and a force to shift the first sidewall from the second sidewall in the lateral direction may act. Even in such a case, according to the configuration of claim 4, because at least a part of the corner engaging projection and at least a part of the side engaging projection are disposed at the same position in the facing direction of the second sidewalls to each other, a sudden reduction in load share of one of the corner engaging projection and the side engaging projection is prevented, and both can be used to resist the lateral force.

MODE FOR CARRYING OUT THE INVENTION

Figure 1:
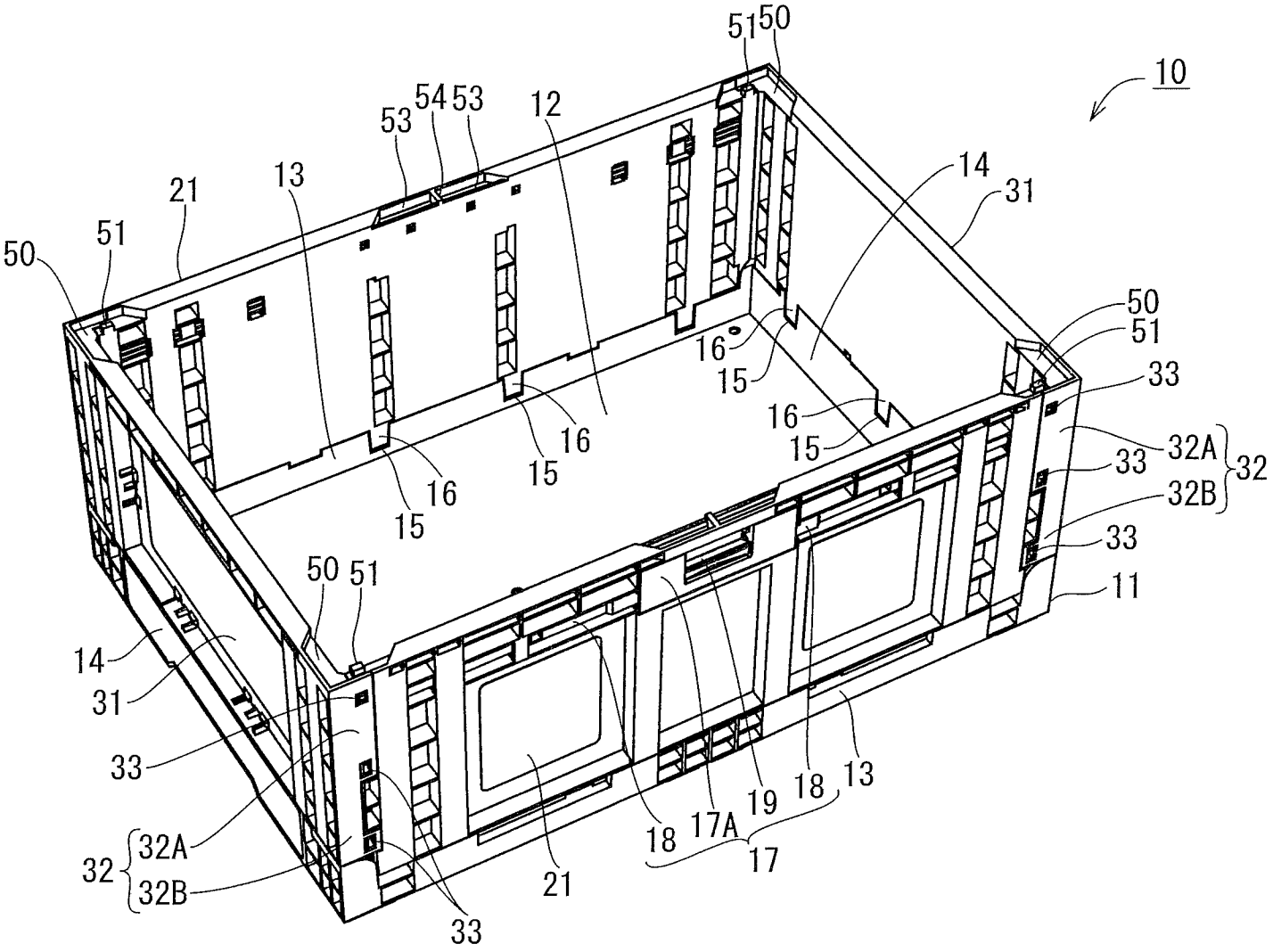
FIG. 1 is a perspective view of a top face side of a container according to an embodiment of the present invention.
Figure 2:
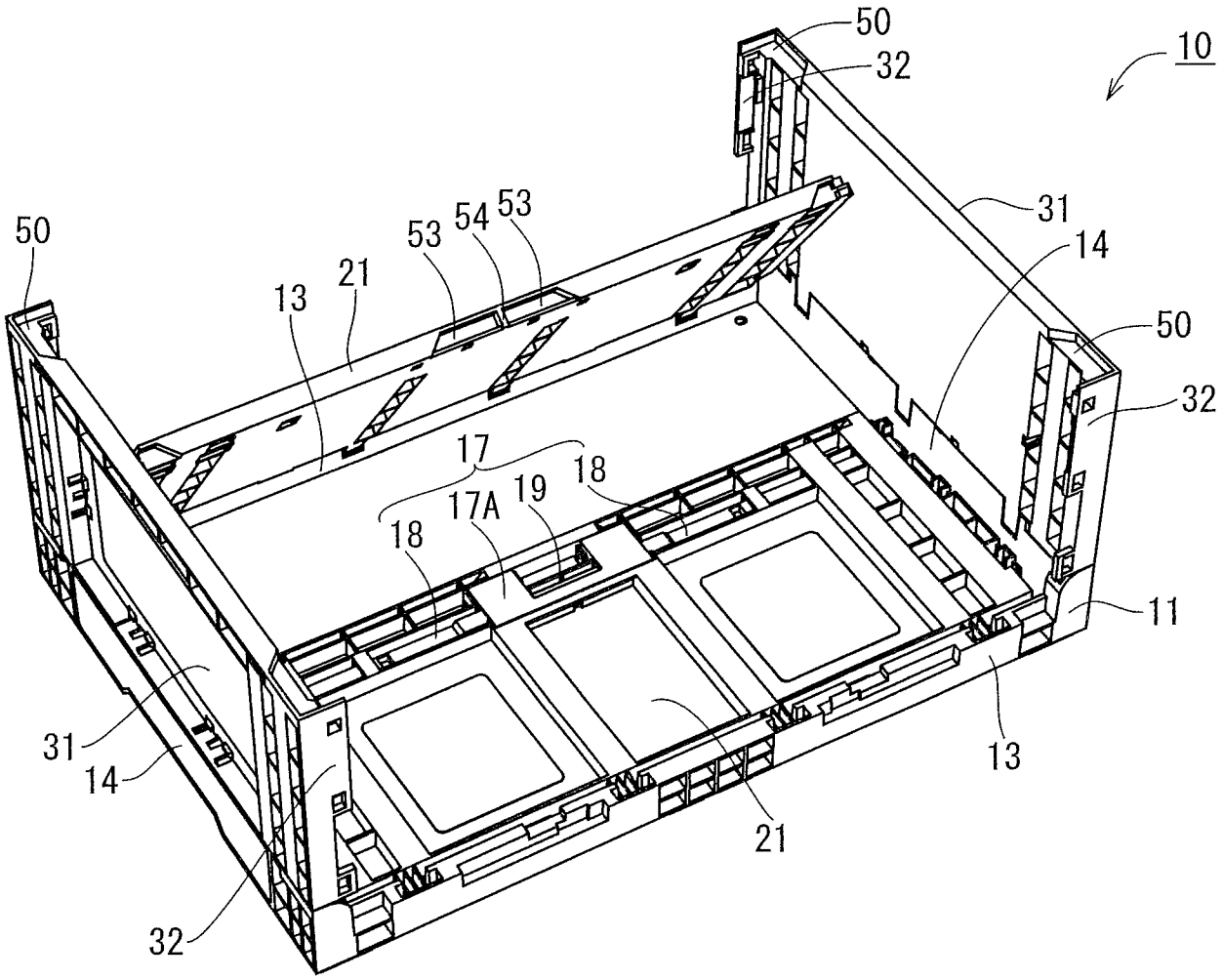
FIG. 2 is a perspective view of the container in the middle of being folded down or in the middle of being assembled.
Figure 3:
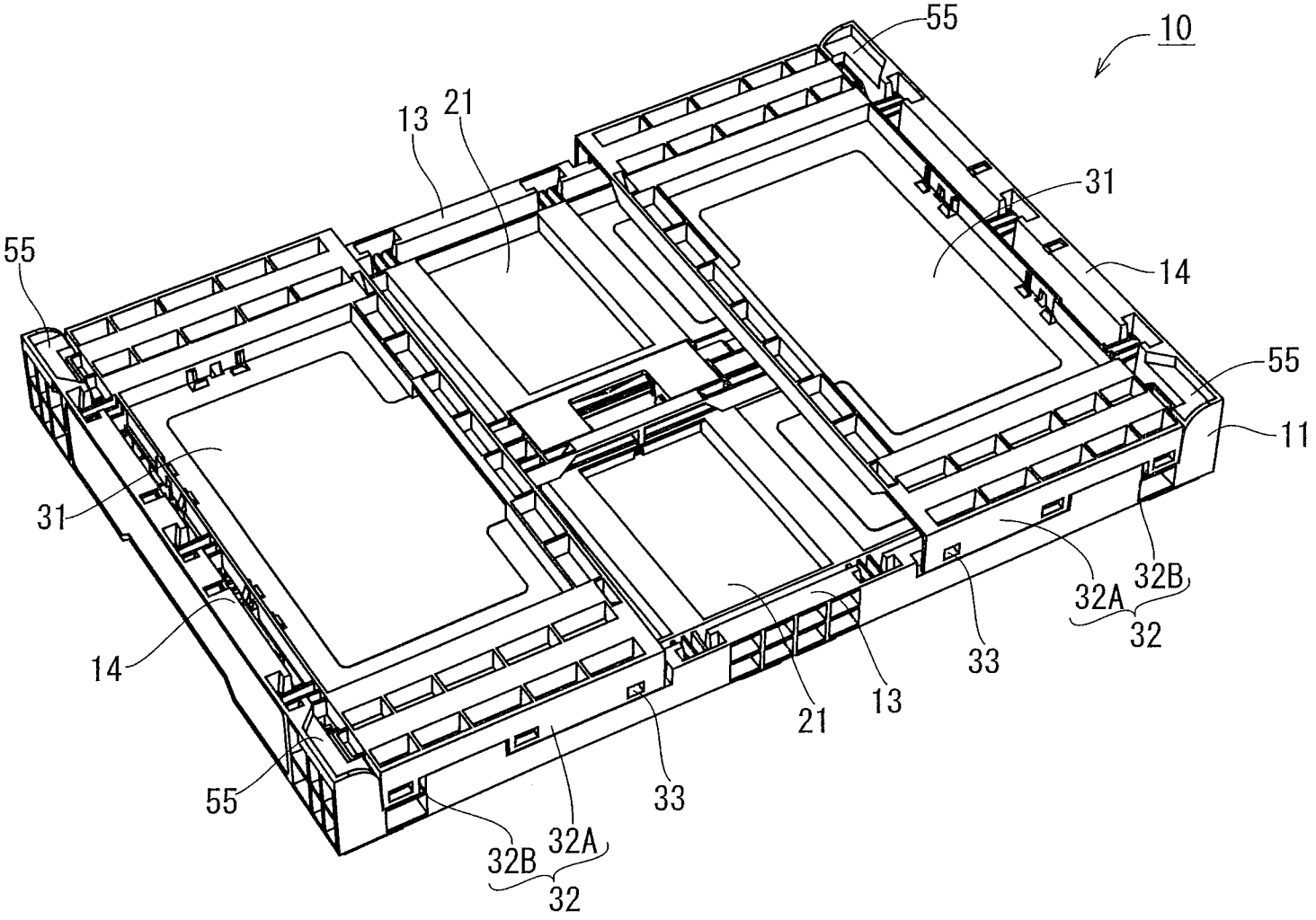
FIG. 3 is a perspective view of the container in a folded state.

Hereinafter, an embodiment of the present invention will be described based on FIG. 1 to FIG. 13. As shown in FIG. 1, a container 10 of the present embodiment is in a box shape open at a top face and shows, for example, a rectangular shape in a plan view, and includes at its long side part a pair of first sidewalls 21 and 21 according to the present invention, and further includes at its short side part a pair of second sidewalls 31 and 31 according to the present invention. Moreover, by folding down the pair of first sidewalls 21 and 21 by turning around lower end portions as shown in FIG. 2 and then folding down the pair of second sidewalls 31 and 31 by turning around lower end portions as shown in FIG. 3, the container 10 is brought into a folded-down state. On the other hand, in reverse order to the above, by erecting the pair of second sidewalls 31 and 31 as shown in FIG. 2 and then erecting the pair of first sidewalls 21 and 21 as shown in FIG. 1, the container 10 is brought into an assembled state.

Figure 5:
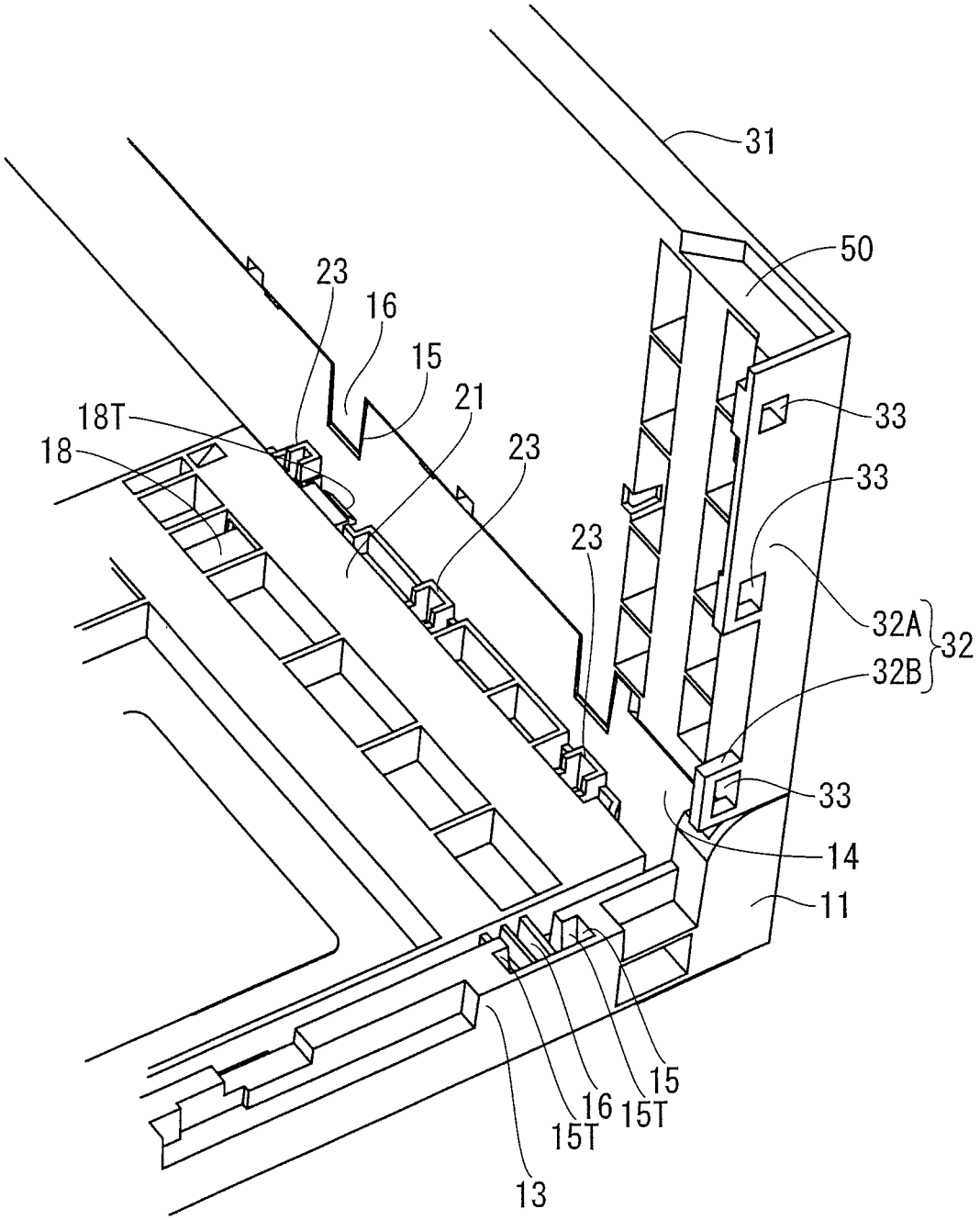
FIG. 5 is a partial perspective view in a folded-down state of the first sidewall.

Specifically, a base member 11 that turnably supports the first and second sidewalls 21 and 31 of the container 10 forms a structure in which a pair of first support walls 13 and 13 are erected from a pair of long-side outer edge portions of a rectangular bottom plate 12 and a pair of second support walls 14 and 14 are erected from a pair of short-side outer edge portions. Also, the second support wall 14 is higher than the first support wall 13. In the base member 11, a plurality of hinge recesses 15 that are open to an upper face and inner face are formed. As shown in FIG. 5, the respective hinge recesses 15 have an inner breadth wider than an opening width of openings in inner side faces of the first and second support walls 13 and 14. Also, in an upper end portion within the hinge recess 15, a pair of latching protrusions 15T and 15T are formed at both sides of the opening in the inner side face. On the other hand, from lower end portions of the first sidewall 21 and the second sidewall 31, a plurality of hinge legs 16 project, and a pair of hinge shafts (not shown) project from both side faces of a lower end portion of each hinge leg 16. Moreover, each hinge leg 16 is received in each hinge recess 15, and the pair of hinge shafts of each hinge leg 16 are latched with the pair of latching protrusions 15T and 15T in the hinge recess 15 from below.

The first sidewall 21 can accordingly be changed into an erected position (refer to FIG. 1) in which the same are vertically erected on the first support wall 13 and into a folded-down position (refer to FIG. 3) in which the same is horizontal on the bottom plate 12, and is restrained from turning outwards from the erected position. Likewise, the second sidewall 31 can also be changed into an erected position (refer to FIG. 1) and a folded-down position (refer to FIG. 3), and is restrained from turning outwards from the erected position.

As shown in FIG. 2, each first sidewall 21 has a size to be sandwiched between the pair of second sidewalls 31 and 31 that are in the erected position. Accordingly, when the container 10 reaches an assembled state as shown in FIG. 1, the pair of second sidewalls 31 and 31 are restrained from turning inwards by the first sidewall 21.

As shown in FIG. 2, from both side portions of the second sidewall 31, side projection pieces 32 extend toward the first sidewalls 21 and 21. Moreover, as shown in FIG. 1, when an assembled state of the container 10 is brought about, the side projection pieces 32 of each second sidewall 31 overlap a side portion of an outer face of each first sidewall 21, which restrains the first sidewall 21 from turning outwards. Also, as shown in FIG. 5, the side projection piece 32 consists of a longitudinally long first side projection piece 32A formed ranging from an upper end portion of the second sidewall 31 to a substantially central position in top-bottom direction and a second side projection piece 32B formed at a position close to the lower end of the second sidewall 31.

In the first side projection piece 32A, quadrilateral side engaging holes 33 are formed at an upper end portion and a lower end portion, respectively. Also, in the second side projection piece 32B, a side engaging hole 33 that is the same in size as the side engaging hole 33 at the lower end portion of the first side projection piece 32A is formed. In addition, the second side projection piece 32B shows a quadrilateral shape slightly larger than the side engaging hole 33.

On the other hand, both side portions of the outer face of the first sidewall 21 cave in at parts to overlap the first and second side projection pieces 32A and 32B by a thickness of those first and second side projection pieces 32A and 32B, and a plurality of side engaging projections 23 project from positions corresponding to the plurality of side engaging holes 33 of the cave-in parts. Moreover, when the container 10 reaches an assembled state, the side engaging projections 23 are concave-convex engaged with the side engaging holes 33, and accordingly, the second sidewall 33 is restrained from falling outwards.

Figure 4:
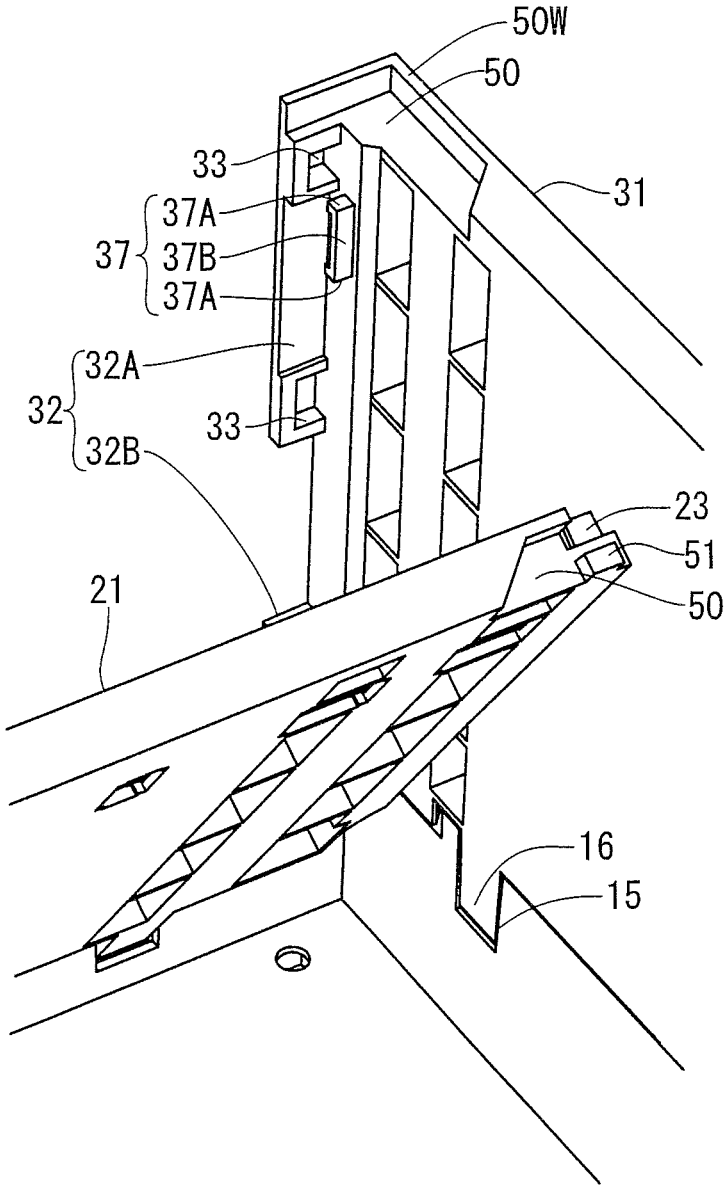
FIG. 4 is a partial perspective view in the middle of folding down a first sidewall.

As shown in FIG. 1, in order to restrain the pair of first sidewalls 21 and 21 from falling inwards in an assembled state of the container 10, each first sidewall 21 is provided with a locking mechanism 17, while the second sidewall 31 is provided with a locking engagement portion 37 (refer to FIG. 4). Specifically, the lock mechanism 17 consists of a pair of locking bars 18 and 18 that extend from a lateral central portion in an upper outer face portion of each first sidewall 21 respectively to both lateral end portions and a locking operation portion 19 that extends laterally in the lateral central portion of the upper outer face portion of the sidewall 21 and is joined with the pair of locking bars 18 and 18 at both end portions thereof. The joint parts of both end portions of the locking operation portion 19 and the locking bars 18 and 18 are covered with a cover 17A from outside. Also, the pair of locking bars 18 and 18 are biased in such a manner that their distal ends slide between locking positions arranged at positions substantially identical to those of both lateral end faces of the first sidewall 21 and an unlocking position shifted from these locking positions to a lateral central side of the first sidewall 21 and are normally disposed at the locking positions. Moreover, by operating the locking operation portion 19 so as to turn downward, the locking bars 18 and 18 move to the unlocking position.

On the other hand, the locking engagement portion 37 forms, as shown in FIG. 4, a gate-shaped structure in which a bridge portion 37B connects between a pair of leg portions 37A and 37A that project from an inner face of the first side projection piece 32A of the second sidewall 31 and are arranged one above the other. Moreover, by the distal end portion of the locking bar 18 being engaged with an inner side of the locking engagement portion 37 in an assembled state of the container 10, the first sidewall 21 is restrained from falling inwards. In addition, at the distal end portion of the locking bar 18, an inclined face 18T is formed as shown in FIG. 5. When the first sidewall 21 is raised with the second sidewalls 31 and 31 erected, the distal end portion of the locking bar 18 climbs over the bridge portion 37B to be engaged with the locking engagement portion 37 as a result of the inclined face 18T of the locking bar 18 making sliding contact with the bridge portion 37B of the locking engagement portion 37.

Figure 6:
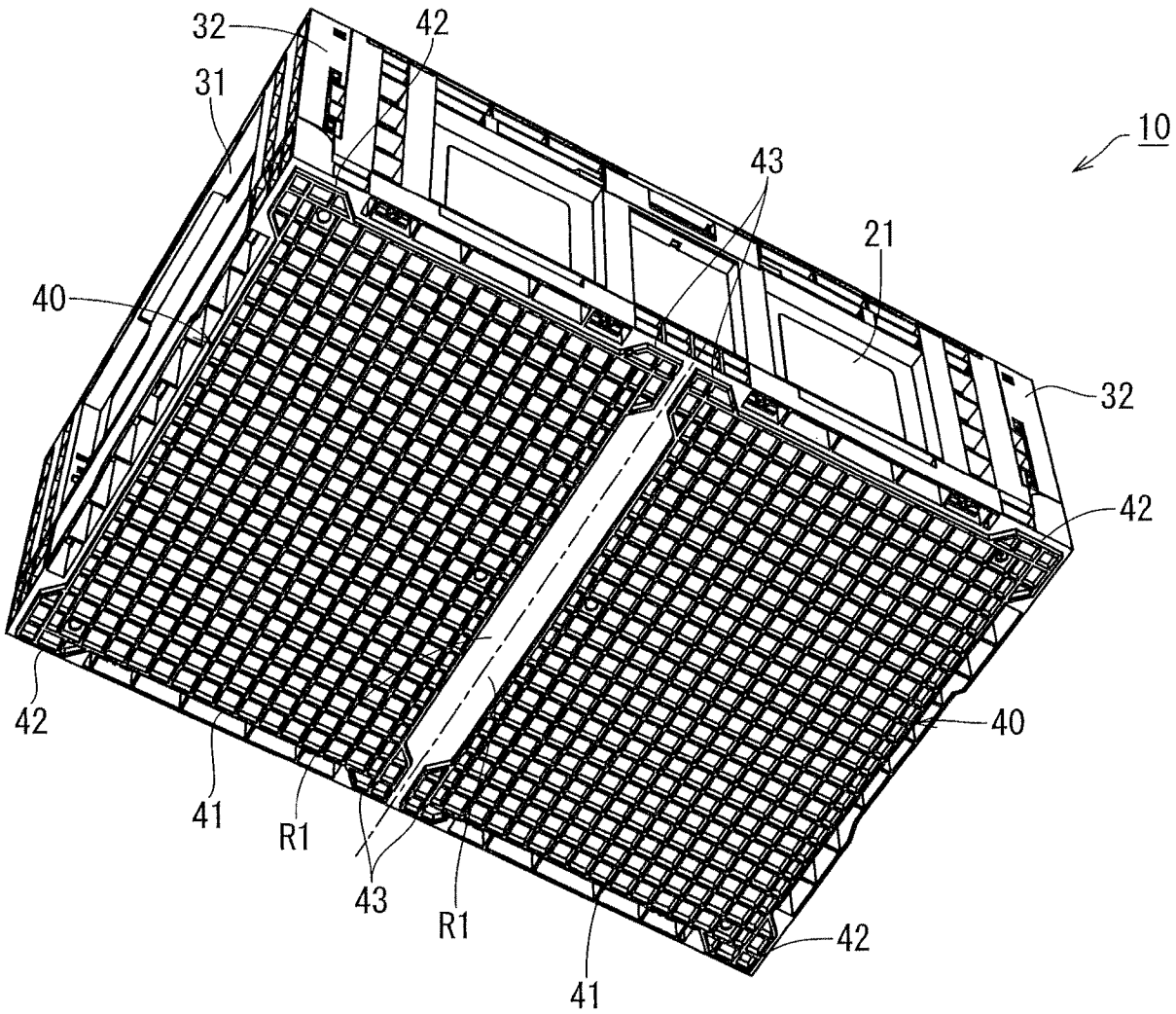
FIG. 6 is a perspective view of a bottom face side of the container.
Figure 7:
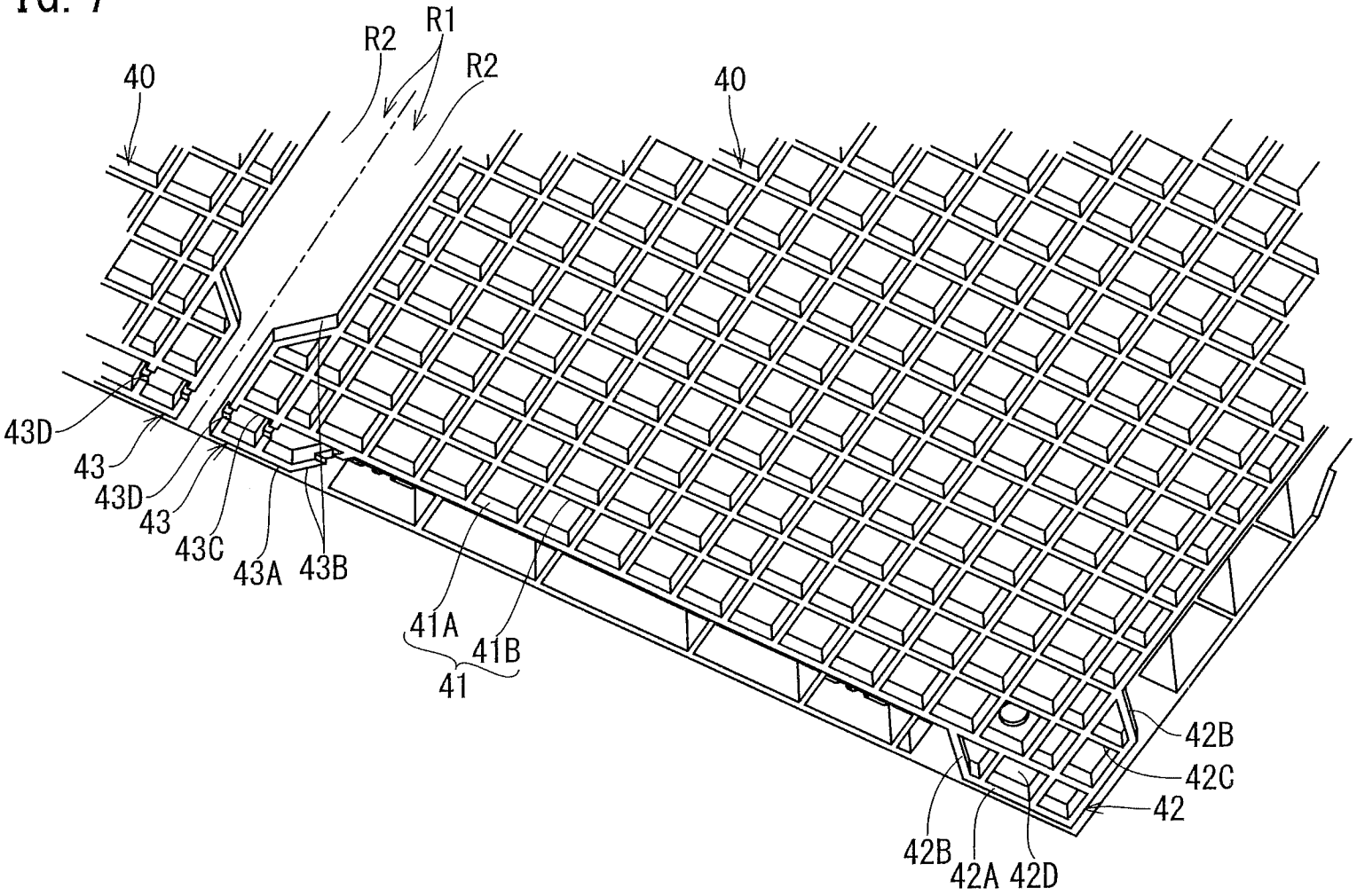
FIG. 7 is a partial perspective view of the bottom face side of the container.

As shown in FIG. 6, on a bottom face of the container 10, a pair of lower-face projections 40 and 40 are formed. Specifically, the bottom face of the container 10 is divided at the center in its longitudinal direction into two half face regions R1 and R1. As shown in FIG. 7, a bottom-face main projection 41 projects from the whole of a part at an inner side than a frame-like region R2 provided along the outer edge of each half face region R1, and a pair of bottom-face sub-projections 42 and 42 and a pair of bottom-face central projections 43 and 43 project from four corners of the frame-like region R2. Moreover, the bottom-face main projection 41, the bottom-face sub-projections 42, and the bottom-face central projections 43 constitute the lower-face projection 40.

The bottom-face main projection 41 consists of a surrounding rib 41 formed along an inner boundary line of the frame-like region R2 and a lattice rib 41B extended over the whole of an inside of the surrounding rib 41A.

The pair of bottom-face sub-projections 42 and 42 are disposed in both longitudinal end portions of the bottom face of the container 10. Each bottom-face sub-projection 42 is disposed at a position close to the outer edge of a corner portion of the frame-like region R2, and consists of an L-shaped wall 42A in an L-shape covering a corner portion of the surrounding rib 41A from the side, a pair of inclined ribs 42B and 42B that connect between both end portions of the L-shaped wall 42A and positions close to the corner portion of the surrounding rib 41A and are inclined so as to separate from the corner portion of the surrounding rib 41A from the L-shaped wall 42A toward the surrounding rib 41A, and sectioning ribs 42C that extend as extensions of the surrounding rib 41A and the lattice rib 41B and connect between the surrounding rib 41A and the L-shaped wall 42A.

The pair of bottom-face central projections 43 and 43 are disposed at a longitudinal central side of the bottom face of the container 10, and similar to the bottom-face sub-projection 42, each bottom-face central projection 43 consists of an L-shaped wall 43A, a pair of inclined ribs 43B and 43B, and sectioning ribs 43C. Also, in a part of the bottom-face central projection 43 to be directly under the erected first sidewall 21 (that is, a position to be directly under the first support wall 13), at a position close to the bottom-face main projection 41, an engagement groove 43D extending in the lateral direction of the first sidewall 21 is formed. The engagement groove 43D shows a shape in which a lower end portion of the bottom-face central projection 43 is cut away into an angled groove shape.

Figure 10:
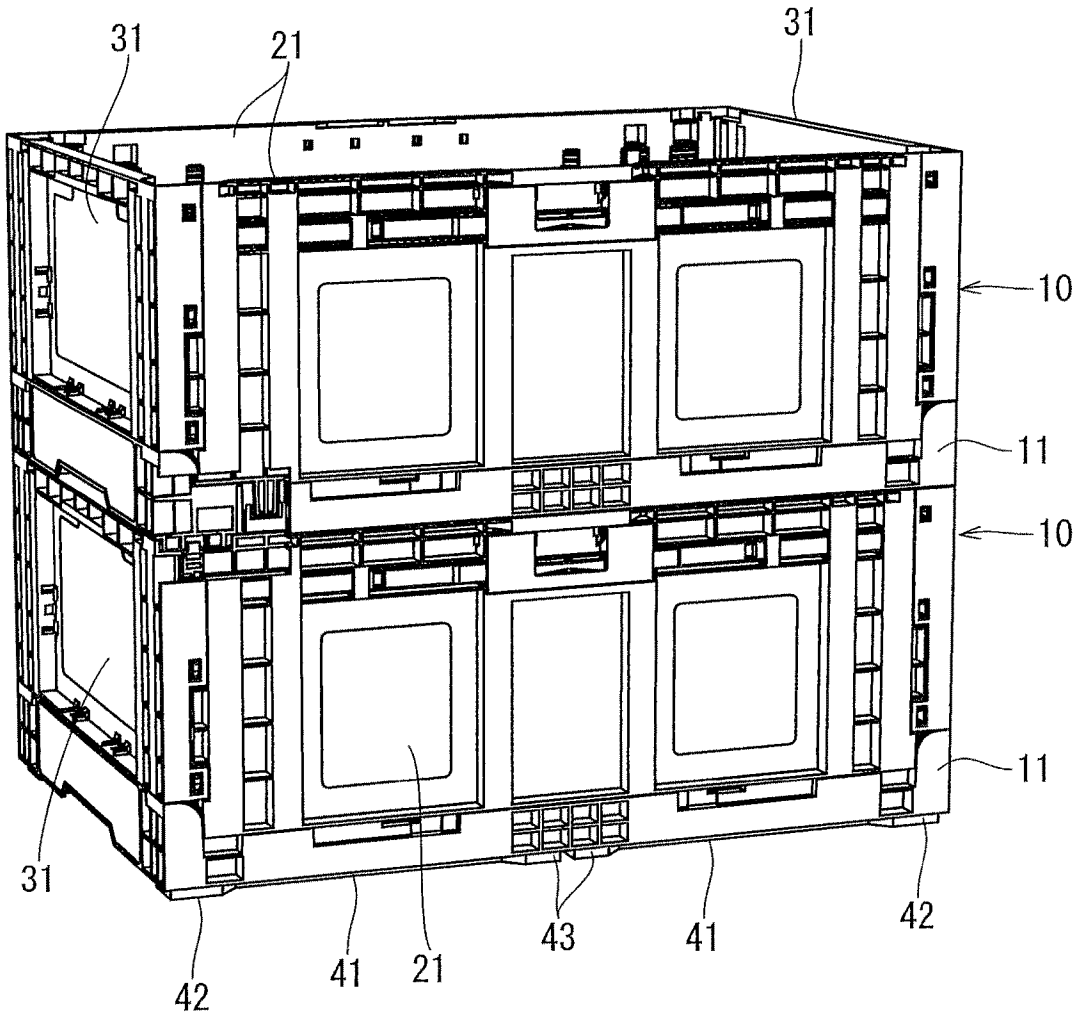
FIG. 10 is a perspective view of stacked containers.

The whole of the frame-like region R2 described above excluding its part sandwiched by the pair of bottom-face main projections 41 is located directly under the first and second sidewalls 21 and 31 in an erected position (that is, directly under the first and second support walls 13 and 14). That is, the bottom-face main projections 41 and 41 of the bottom face of the container 10 formed over the whole of the part at an inner side than the frame-like region R2 are structured to project from a region of the bottom face of the container 10 at an inner side than directly under the first and second sidewalls 21 and 31. When the containers 10 and 10 are stacked on each other as shown in FIG. 10, the bottom-face main projections 41 and 41 of the upper-layer container 10 are accordingly fitted inside a top-face opening of the lower-layer container 10, that is, within an inner side of the first and second sidewalls 21 and 31.

As shown in FIG. 1, in the top face of the container 10, projection receiving recesses 50 and central projection receiving recesses 53 for receiving the bottom-face sub-projections 42 and the bottom-face central projections 43 (refer to FIG. 6) are formed.

Figure 8:
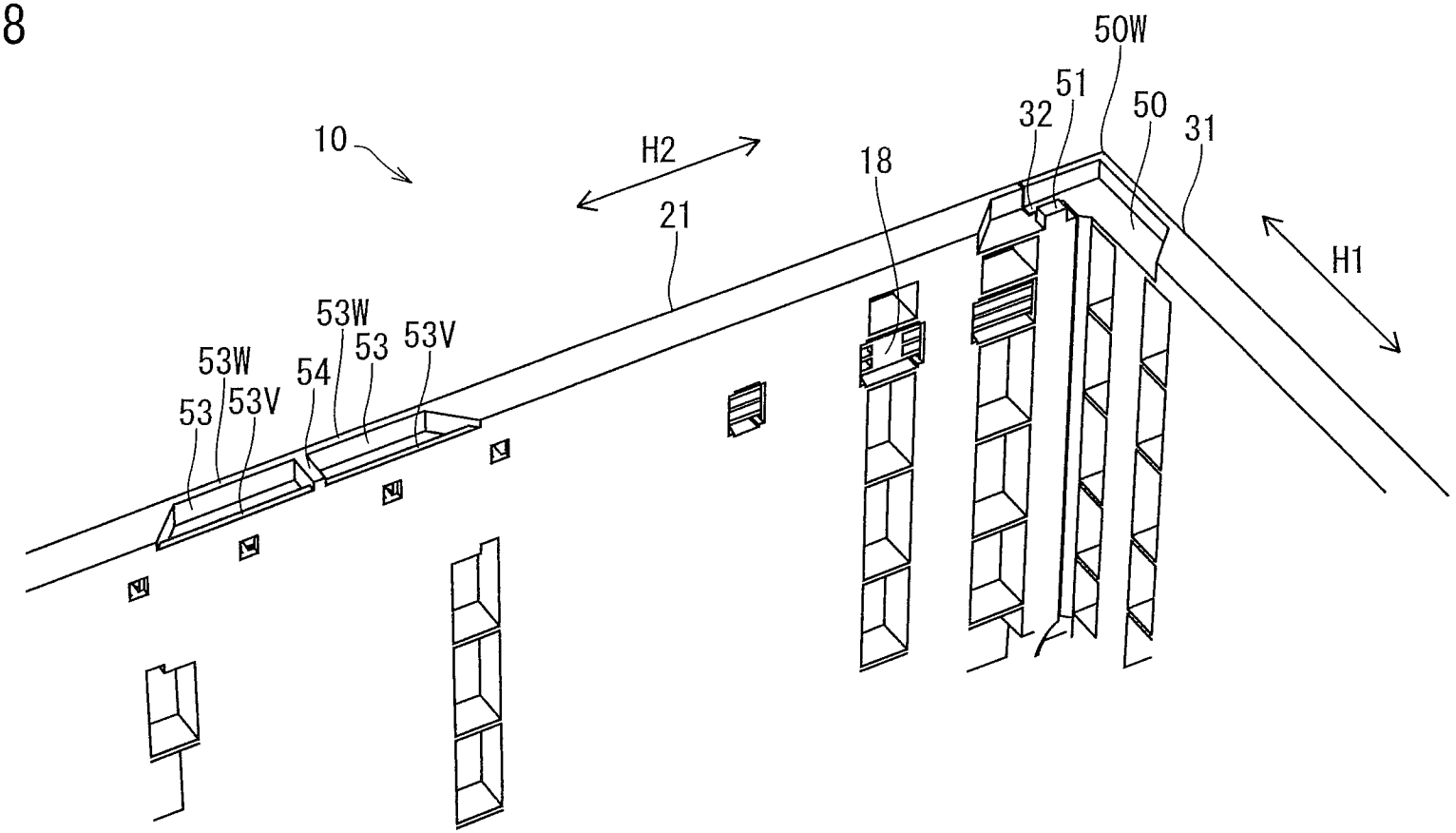
FIG. 8 is a partial perspective view of a top face side of the container.
Figure 13:
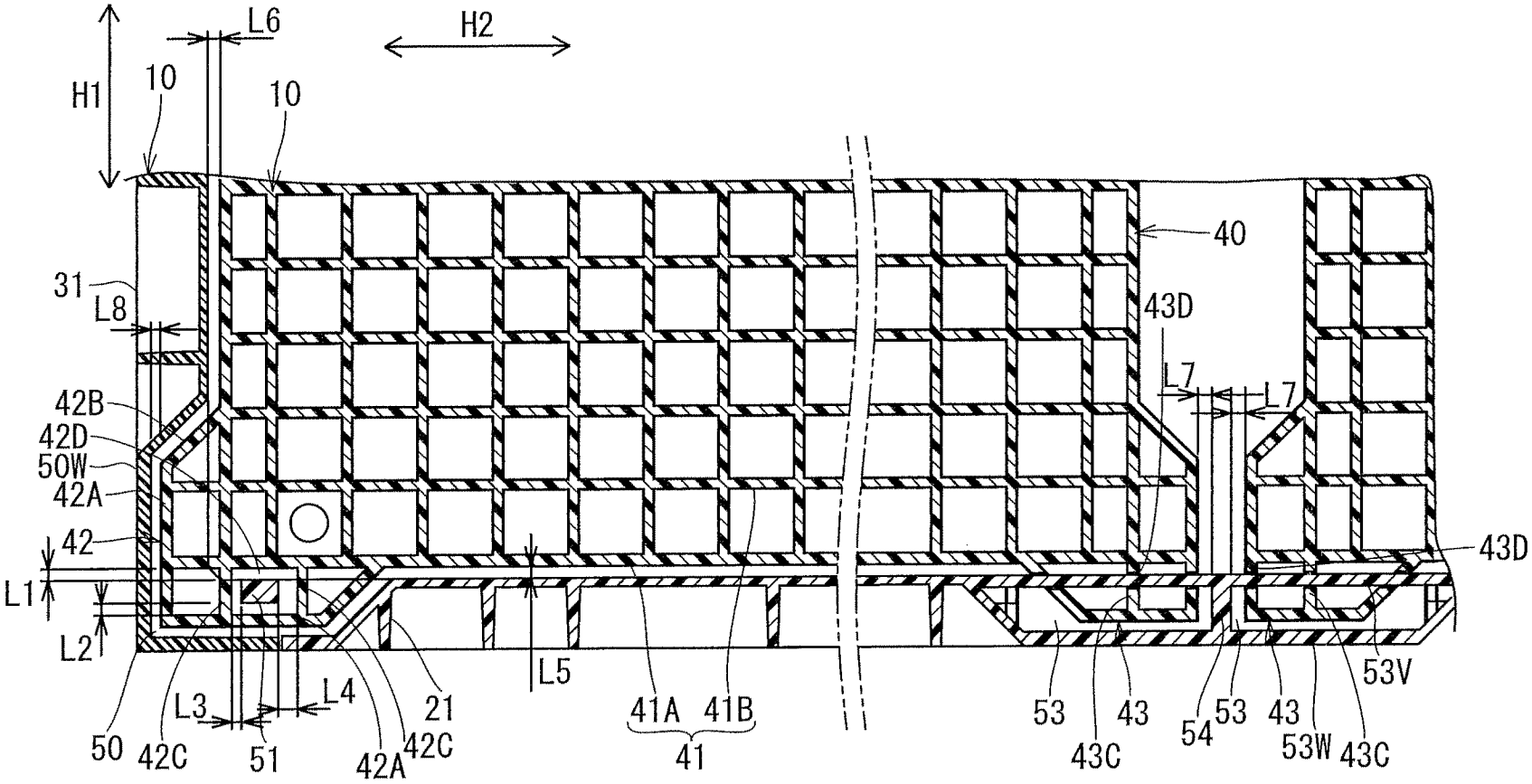
FIG. 13 is a sectional plan view of a fitted part of the stacked containers.

The central projection receiving recesses 53 are for receiving a part of the bottom-face central projections 43 of the upper-layer container 10 when the containers 10 and 10 are stacked, and are formed, in an upper-face central part of each first sidewall 21, by making a longitudinal extending region of the upper face of the first sidewall 21 cave in into a stepped shape. Also, as shown in FIG. 8, at an outer face side of the first sidewall 21 further than the central projection receiving recess 53, a part of the first sidewall 21 is left as an outer vertical wall 53W. Further, at an inner face side of the first sidewall 21 further than the central projection receiving recess 53, an inner vertical wall 53V lower than the outer vertical wall 53W is left. Moreover, the outer vertical wall 53W and the inner vertical wall 53V are connected at their respective longitudinal center positions by a central partition wall 54 therebetween, so that the central projection receiving recess 53 is divided into two part. Also, end portions of the central projection receiving recesses 53 at the sides separated from the central partition wall 54 are inclined with respect to an inner face of the outer vertical wall 53W so as to become parallel with the inclined ribs 43B and 43B (refer to FIG. 7) of the bottom-face central projections 43. Moreover, when the containers 10 and 10 are stacked as shown in FIG. 10, as shown in FIG. 13, an outer part further than the engagement groove 43D of each bottom-face central projection 43 of the upper-layer container 10 is received in each central projection receiving recess 53 of the lower-layer container 10, and in the engagement groove 43D of the upper-layer container 10, the inner vertical wall 53V of the lower-layer container 10 is received.

On the other hand, the projection receiving recesses 50 are for, when the containers 10 and 10 are stacked, receiving the bottom-face sub-projections 42 of the upper-layer container 10, and are formed, as shown in FIG. 1, by making a substantially L-shaped region across the first sidewall 21 and the second sidewall 31 adjacent to each other in corner portions at four corners of the top face of the container 10 cave in into a stepped shape. Also, as shown in FIG. 8, at outer face sides of the first sidewall 21 and the second sidewall 31 further than the projection receiving recess 50, a part of the first sidewall 21 and the second sidewall 31 is left as a vertical wall 50W. Apart of the vertical wall 50W is constructed by an upper end portion of the side projection piece 32 mentioned above. Also, in the first sidewall 21, the projection receiving recess 50 is formed extending to a position separated from the corner portion further than the part where the side projection piece 32 overlaps. In addition, two inner side faces of the projection receiving recess 50 separated from the corner portion are inclined with respect to an inner face of the vertical wall 50W so as to become parallel with the inclined ribs 42B and 42B of the bottom-face sub-projections 42.

Figure 9:
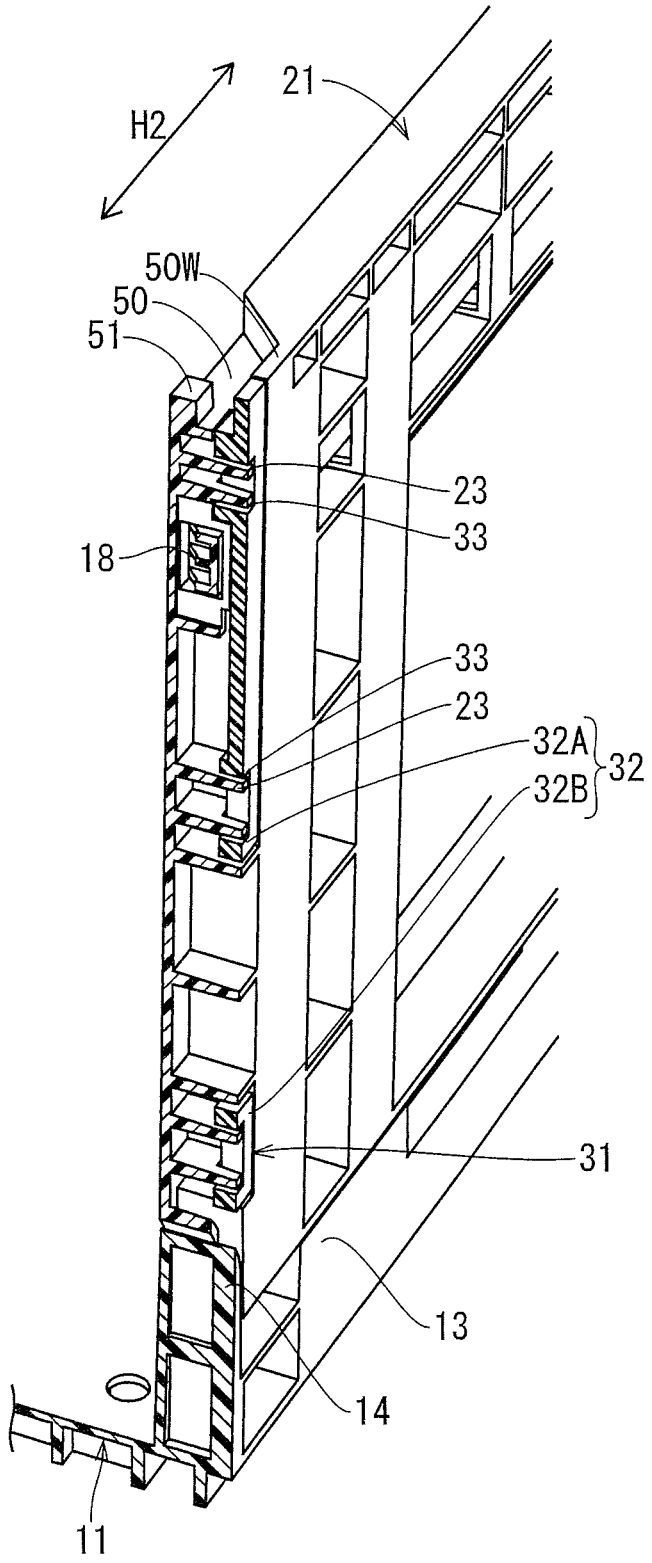
FIG. 9 is a partially broken perspective view of the container longitudinally sectioned in part.
Figure 11:
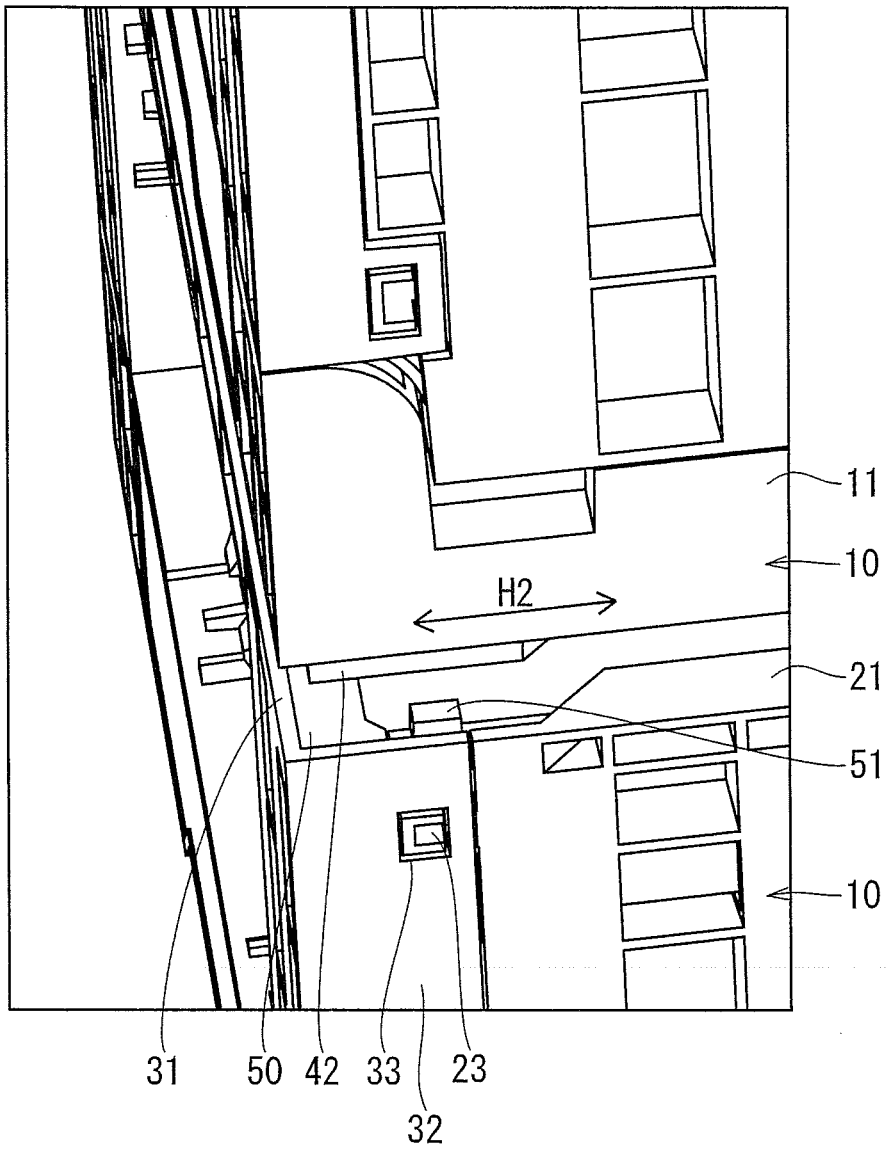
FIG. 11 is a perspective view of a corner part of the containers in the middle of being stacked.

From a bottom face of the projection receiving recess 50 in the first sidewall 21, a corner engaging projection 51 projects. The corner engaging projection 51 shows a prism shape, and is disposed at a position where the corner engaging projection 51 in whole overlaps the side projection piece 32 when viewed in a first horizontal direction H1 in which the first sidewalls 21 and 21 face each other. Also, as shown in FIG. 9, in a second horizontal direction H2 in which the second sidewalls 31 and 31 face each other, the corner engaging projection 51 is disposed at a position substantially identical to that of the side engaging projection 23 and the side engaging hole 33. In greater detail, as shown in FIG. 11, the corner engaging projection 51 is slightly shifted in the second horizontal direction H2 from the side engaging projection 23 and the side engaging hole 33 to a side to separate from the second sidewall 31. The corner engaging projection 51 is disposed at a position where a part of the corner engaging projection 51 and a part of the side engaging projection 23 and the side engaging hole 33 overlap in the second horizontal direction H2.

Figure 12:
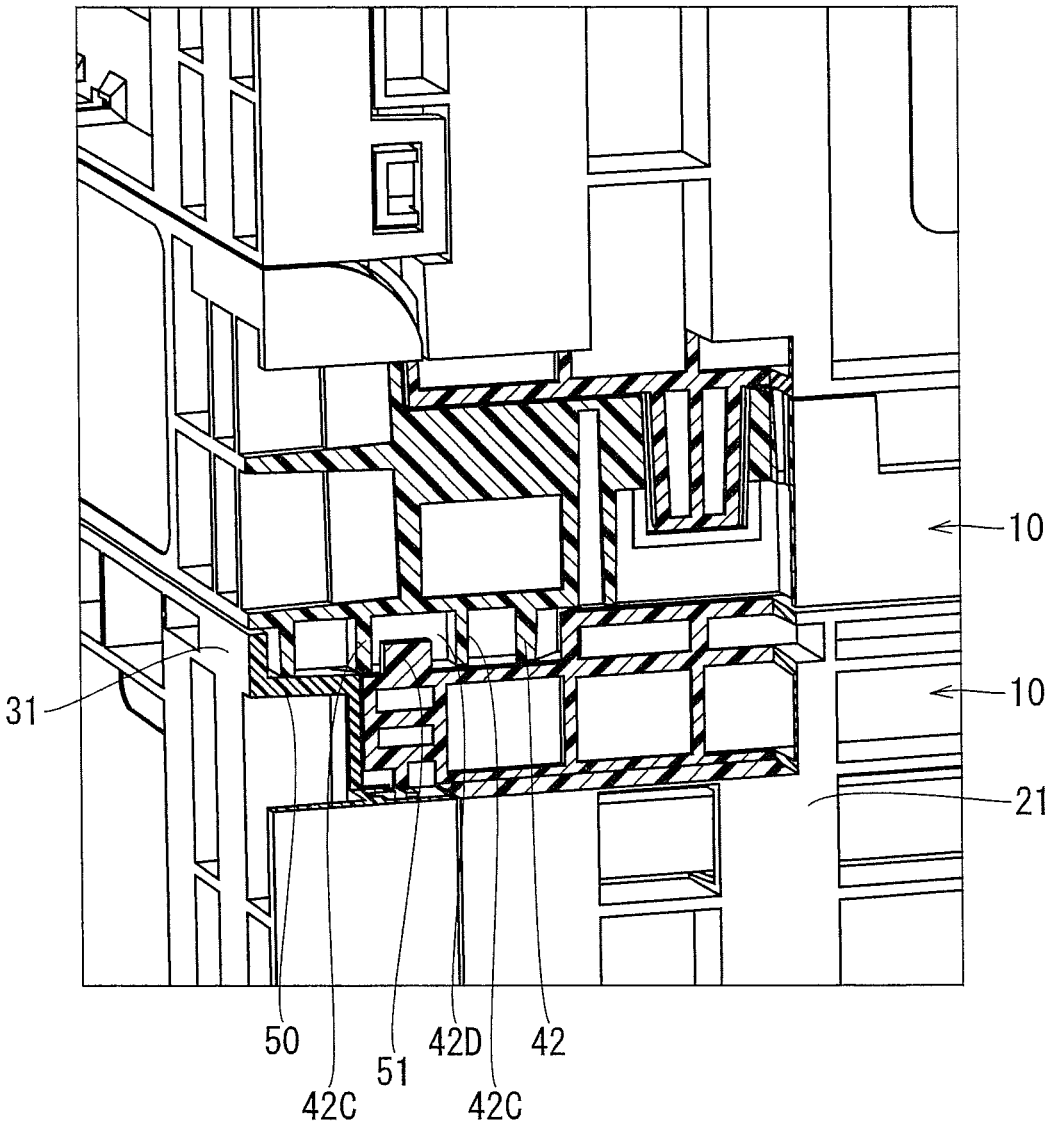
FIG. 12 is a partially broken perspective view of a corner part of the stacked containers.

In addition, as shown in FIG. 9 and FIG. 12, an upper face of the corner engaging projection 51 is located lower than the upper face of the first and second sidewalls 21 and 31.

When the containers 10 and 10 are stacked on each other as shown in FIG. 10, as shown in FIG. 12, the bottom-face sub-projection 42 is received in the projection receiving recess 50, and the corner engaging projection 51 is engaged with a corner engaging recess 42D provided as a single recess sectioned by the sectioning ribs 42C of the bottom-face sub-projection 42. As shown in FIG. 13, the corner engaging recess 42D forms a structure that is surrounded on four sides by a pair of sectioning ribs 42C and 42C facing in the second horizontal direction H2 and the L-shaped wall 42A and the surrounding rib 41A facing in the first horizontal direction H1. Also, as shown in FIG. 13, when a pair of containers 10 and 10 are stacked without mutual displacement in the horizontal direction, in the first horizontal direction H1, a gap L1 is formed between the corner engaging projection 51 and the surrounding rib 41A of the corner engaging recess 42D, and a gap L2 is formed between the corner engaging projection 51 and the L-shaped wall 42A of the corner engaging recess 42D. Also, in the second horizontal direction H2, a gap L3 is formed between the corner engaging projection 51 and the sectioning rib 42C at the side separated from the bottom-face central projections 43, and a gap L4 is formed between the corner engaging projection 51 and the sectioning rib 42C at the side of the bottom-face central projections 43. Moreover, of these gaps L1 to L4, the gaps L1 to L3 are substantially identical to each other, and the gap L4 is larger than the gaps L1 to L3. Furthermore, compared with a gap L5 between the bottom-face main projection 41 and the inner side face of the first sidewall 21 in the first horizontal direction H1 and a gap L6 between the bottom-face main projection 41 and the inner side face of the second sidewall 31, a gap L7 between the bottom-face central projection 43 and the central partition wall 54, and a gap L8 between the bottom-face sub-projection 42 and the vertical wall 50W in the second horizontal direction H2, the gaps L1 to L3 on the corner engaging projection 51 mentioned above are substantially identical within the margin of manufacturing variations.

In addition, as shown in FIG. 3, in the second support walls 14 and 14 of the base member 11, support wall recesses 55 and 55 are formed at both longitudinal end portions of their upper faces. The support wall recess 55 shows a shape identical to that of a part located directly above the second support wall 14 of the projection receiving recess 50 mentioned above, and when the container 10 is brought into a folded-down state and another container 10 is stacked thereon, the bottom-face sub-projection 42 of the upper-layer container 10 is received in the support wall recess 55.

The structure of the container 10 of the present embodiment is described above. Next, operation and effects of the container 10 will be described. As the container 10 of the present embodiment, a plurality of containers in which content is stored are sometimes stacked and loaded on a vehicle and transported. A great lateral load may be exerted to the first sidewall 21 or the second sidewall 31 of the lower-layer container 10 when the vehicle is accelerated or decelerated. In such a case, with the container 10 of the present embodiment, the corner engaging projection 51 and the corner engaging recess 42D are engaged at the four corners on the bottom face and the top face of a top container 10 and a bottom container 10 when stacked, which thereby allows such containers to hold up against the received lateral load when stacked, by dispersing the lateral load more widely than conventional containers. Thus, the containers of the present embodiment achieve a higher strength against the lateral load when stacked than conventional containers and prevent incidents where the first sidewall 21 and the second sidewall 31 would be separated from each other due to the first sidewall 21 or the second sidewall 31 being pushed and bent outwards.

Specifically, when one of the second sidewalls 31 of the lower-layer container 10 is pressed by a lateral load received by the stacked containers 10 and 10, the lateral load is received by contact between the one second sidewall 31 of the lower-layer container 10 and the bottom-face main projection 41 of the upper-layer container 10, contact between the corner engaging projections 51 and 51 at the side of the other second sidewall 31 of the lower-layer container 10 and inner faces of the corner engaging recesses 42D and 42D of the upper-layer container 10, contact between the bottom-face central protrusion 43D of the lower-layer container 10 and the central partition wall 54 of the upper-layer container 10, and contact between the side engaging projection 23 of the lower-layer container 10 and the side engaging hole 33 of the lower-layer container 10. The containers 10 of the present embodiment can thus hold up against the lateral load by dispersing the lateral load more widely than conventional containers, and achieve a higher strength against the lateral load. Also, the side engaging projection 23 is reduced in load share and is prevented from being sheared.

When one of the first sidewalls 21 of the lower-layer container 10 is pressed by a lateral load received by the stacked containers 10, the lateral load is received by contact between the one first sidewall 21 of the lower-layer container 10 and the bottom-face main projection 41 of the upper-layer container 10, contact between the corner engaging projections 51 and 51 at the side of the other first sidewall 21 of the lower-layer container 10 and inner faces of the corner engaging recesses 42D and 42D of the upper-layer container 10, contact between the one first sidewall 21 of the lower-layer container 10 and the side projection piece 32, and contact between the inner vertical wall 53V of the lower-layer container 10 and an inner face of the engagement groove 43D in the bottom-face central projection 43 of the upper-layer container 10. The containers 10 of the present embodiment can thus hold up against the lateral load by dispersing the lateral load more widely than conventional containers, and achieve a higher strength against the lateral load. Furthermore, because the corner engaging projection 51 is disposed at a position to overlap the side projection piece 32 when viewed in the facing direction of the first sidewalls 21 and 21 to each other, a higher strength is achieved against the lateral load in the facing direction of the first sidewalls 21 and 21 to each other.

Also, when the first sidewall 21 of the lower-layer container 10 is pressed by a lateral load received by the stacked containers 10, the first sidewall 21 is deformed to bulge out so that the first sidewall 21 bulges in its lateral center and a force to displace the first sidewall 21 from the second sidewall 31 in the lateral direction may act. Even in such a case, with the container 10 of the present embodiment, because at least a part of the corner engaging projection 51 and at least a part of the side engaging projection 23 are disposed at the same position in the facing direction of the second sidewalls 31 to each other, a sudden reduction in load share of one of the corner engaging projection 51 and the side engaging projection 23 is prevented, and both can be used to resist the lateral load. In addition, because the corner engaging projection 51 projects from the bottom face of the projection receiving recess 50, the corner engaging projection 51 does not also obstruct motion of taking content in and out of the container 10.

[Other embodiments]

The present invention is not limited to the above-mentioned embodiment, and for example, such embodiments as to be described in the following are also included in the technical scope of the present invention, and further, the present invention can be carried out by various modifications within the scope not deviating from the gist thereof.

(1) In the container 10 of the above-mentioned embodiment, the corner engaging projection 51 is provided on only the bottom face at the side of the first sidewall 21 of the projection receiving recess 50, but the corner engaging projection 51 may be provided on only the bottom face at the side of the second sidewall 31 in the respective projection receiving recess 50, and the corner engaging projections 51 may be respectively provided on both of the bottom face at the side of the first sidewall 21 and the bottom face at the side of the second sidewall 31 in each projection receiving recess 50. In addition, providing a configuration in which, as in the container 10 of the above-mentioned embodiment, the corner engaging projection 51 is provided only in the first sidewall 21 makes it unlikely, when a stacking method of containers 10 is performed in which the upper-layer container 10 is inclined to align a part directly under one of the second sidewalls 31 with the lower-layer container 10 and brought into a horizontal position, that the corner engaging projection 51 of the lower-layer container 10 is caught in the upper-layer container 10.

(2) In the container 10 of the above-mentioned embodiment, the side engaging hole 33 penetrates through the side projection piece 32, but the side engaging hole 33 may not be structured to penetrate through the side projection piece 32.

(3) The container 10 of the above-mentioned embodiment includes, on its bottom face, the bottom-face central projection 43 in addition to the bottom-face sub-projection 42, but the container may be configured to include only the bottom-face sub-projection 42.

(4) In the container 10 of the above-mentioned embodiment, the inner vertical walls 53V are formed on both sides of the central partition wall 54 in the central projection receiving recess 53, and the engagement grooves 43D are formed correspondingly thereto in the respective bottom-face central projections 43, but engaging projections (not shown) may be respectively provided on both sides of the central partition wall 54 in the central projection receiving recess 53 in place of the inner vertical walls 53V, and the engagement grooves 43D of the respective bottom-face central projections 43 are eliminated, and an engaging recess provided as a single recess sectioned by the sectioning ribs 43C of the bottom-face central projection 43 and the above-mentioned engaging projections are engaged.

DESCRIPTION OF THE REFERENCE NUMERAL

10 Container
21 First sidewall
23 Side engaging projection
31 Second sidewall
32 Side projection piece
33 Side engaging hole
41 Bottom-face main projection
42 Bottom-face sub-projection
42D Corner engaging recess
50 Projection receiving recess
51 Corner engaging projection

The invention claimed is:

1. A stackable container which has four sidewalls and a bottom wall forming a box shape that has an open top, and allows folding down a first pair of first sidewalls of the four sidewalls facing each other by turning around lower end portions and then folding down a second pair of second sidewalls of the four sidewalls by turning around lower end portions, the container comprising:

a pair of bottom-face main projections that project from a bottom face of the bottom wall, the bottom face facing to an exterior of the container, the pair of bottom-face main projections being on opposite parts of the bottom face in a direction perpendicular to the pair of the second sidewalls facing each other, and the pair of bottom-face main projections being configured to fit inside an opening in a top of another same stackable container;

a bottom-face central projection that projects from the bottom face directly beneath the first sidewall at a central portion of the bottom face in the direction perpendicular to the pair of the second sidewalls facing each other, the bottom-face central projection being integral with each of corner portions of the bottom-face main projections at the central portion and having a lower face being flush with a lower face of the bottom-face main projections;

a bottom-face sub-projection that projects from four corners of the bottom face directly beneath the first sidewall and the second sidewall, the bottom-face sub-projection being integral with each of corner portions at sides of the bottom-face main projections that are opposite to the central portion and having a lower face flush with the lower face of the bottom-face main projection;

a projection receiving recess that is formed across adjacent top edges of the first sidewall and the second sidewall at four corners of the container, and is configured to receive a same bottom-face sub-projection of another same stackable container;

a central projection receiving recess that is formed in a central part of the top edge of the first sidewall and is configured to receive a same bottom-face central projection of another same stackable container;

a corner engaging recess formed in the lower face of the bottom-face sub-projection;

an engaging recess formed in the lower face of the bottom-face central projection;

a corner engaging projection that projects from a bottom face of the projection receiving recess, and is configured to engage with a same corner engaging recess of another same stackable container to restrain a lateral shift of the upper and lower containers with respect to each other;

a central partition wall that projects from a bottom face of the central projection receiving recess, and divides the central projection receiving recess into two parts in the direction perpendicular to the pair of the second sidewalls facing each other; and an engaging projection that projects from the bottom face of the central projection receiving recess on both sides of the central partition wall, and is configured to engage with a same engaging recess of another same stackable container to restrain a lateral shift of the upper and lower containers with respect to each other.

2. The container according to claim 1, comprising:

a side projection piece that extends from each side portion of the second sidewall, and is overlapped with an outer side of each side portion of the first sidewall;

a side engaging hole formed in the side projection piece;

a side engaging projection that projects from an outer face of each side portion of the first sidewall, and is engaged with the side engaging hole; and the corner engaging projection provided in the first sidewall.

3. The container according to claim 2, comprising the corner engaging projection disposed at a position to overlap the side projection piece when viewed in a direction perpendicular to the pair of the first sidewalls facing each other.

4. The container according to claim 3, wherein at least a part of the corner engaging projection and at least a part of the side engaging projection are disposed at the same position in the direction perpendicular to the pair of the second sidewalls facing each other.

* * * * *